US006283797B1

(12) United States Patent
Wu

(10) Patent No.: US 6,283,797 B1
(45) Date of Patent: Sep. 4, 2001

(54) STRUCTURE OF A LAMP BASE

(76) Inventor: Jeng-shyong Wu, No. 14, Alley 1, Lane 326, Shin-Pin Rd., Hsinchu (TW)

( * ) Notice: Subject to any disclaimer, the term of this patent is extended or adjusted under 35 U.S.C. 154(b) by 0 days.

(21) Appl. No.: 09/363,888

(22) Filed: Jul. 30, 1999

(51) Int. Cl.[7] ..... H01K 1/00
(52) U.S. Cl. ..... 439/699.2; 439/619
(58) Field of Search ..... 439/505, 619, 439/699.2, 575

(56) References Cited

U.S. PATENT DOCUMENTS 6,053,774 * 4/2000 Lin ..... 439/619

* cited by examiner

*Primary Examiner*—Khiem Nguyen
(74) *Attorney, Agent, or Firm*—Dougherty & Troxell

(57) ABSTRACT

An improvement in the structure of a lamp base, it includes a lamp socket, a lamp, a pair of connection copper plug, a resistor sheet, a lamp base unit and a pair of wire. A lamp can be plugged into the lamp socket, and there are conductive sheets at both bottom sides of the lamp socket. Each of the conductive sheet at the bottom side of the lamp socket contacts with a connection copper plug, the upper portion of the connection copper plug is in the form of plate, and a resistor sheet can be placed in between the two connection copper plug, and a wire fixture is formed under the connection copper plug which can fix the wire, and the wire is connected to the other lamp base unit of the lamp series, then when the lamp series are turned on, the current will flow to connect copper plug under the lamp socket to light on the lamp in the lamp base of the lamp series, however, if the lamp is burn up or loosen, the resistor sheet will become short to make the lamps in other lamp base units light on as the same; the connection copper sheet is provided with a fixture to fix the resistor sheet at the determined position to prevent loosening.

3 Claims, 5 Drawing Sheets

STRUCTURE OF A LAMP BASE

BACKGROUND OF THE INVENTION

1. Field of the Invention

The present invention relates to an improvement of the structure of a lamp base, particularly to an improvement of the structure of a lamp base of a lamp series (such as Christmas lamps). In normal conditions, a resistor sheet thereof is to be operated as a current bypass. When one lamp of the lamp series is open or loose, the resistor sheet will become shorted, therefore, the other lamps of the lamps series can operate as normal.

2. Brief Description of the Prior Art

The present invention relates to an improvement of a structure of lamp base, particularly to a lamp base having a resistor sheet to be operated as a bypass by the current or as a short element, enabling a lamp series to operate as normal even if one or more lamps thereof are shorted or loose.

As everyone knows, lamp series are popularly utilized to decorate a ceremony or a festival, particularly the Christmas lamps decorating in Christmas. However, the conventional lamp series will dysfunction if one lamp of the lamp series is opened because the tungsten wire is burnt out, or one lamp of the lamp series is loose because of vibration. It is troublesome and time-consuming to replace some of these lamps, and it is waste to use a whole new lamp series.

Due to the disadvantages of the conventional lamp series, the present invention then is created to improve the structure of the lamp base.

SUMMARY OF THE INVENTION

The object of the present invention then is to provide an improvement of the structure of the lamp base, and the improved lamp base according to the present invention includes a resistor sheet between the upper and lower protrusions on the copper connection plugs. Thus when the tungsten wire in the lamp is burnt out or the lamp is loose, the resistor sheet becomes shorted and the whole lamp series will light as usual.

Another object of the present invention is to provide an improvement of the structure of a lamp base, which imposes a resistor sheet to be operated as a bypass or a short element, so that the lamp series can be prevented from dysfunctioning while some lamps of the lamp series are burnt out or loose.

A more complete understanding of these and other features and advantages of the present invention will become apparent from a careful detailed description of certain embodiments illustrated in the accompanying drawings.

DETAILED DESCRIPTION OF THE PREFERRED EMBODIMENT

Figure 1:
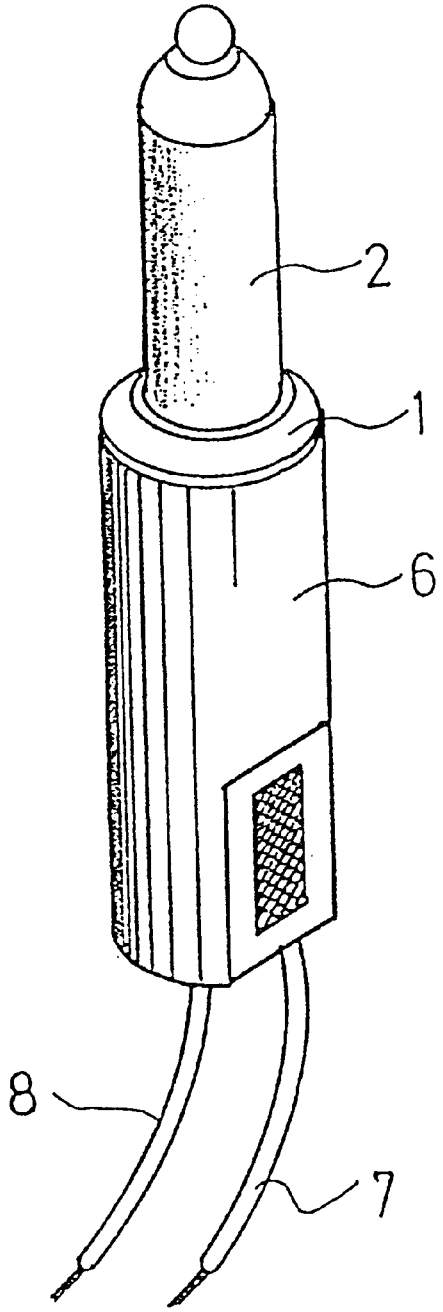
FIG. 1 is a perspective view showing one embodiment of the present invention.
Figure 2:
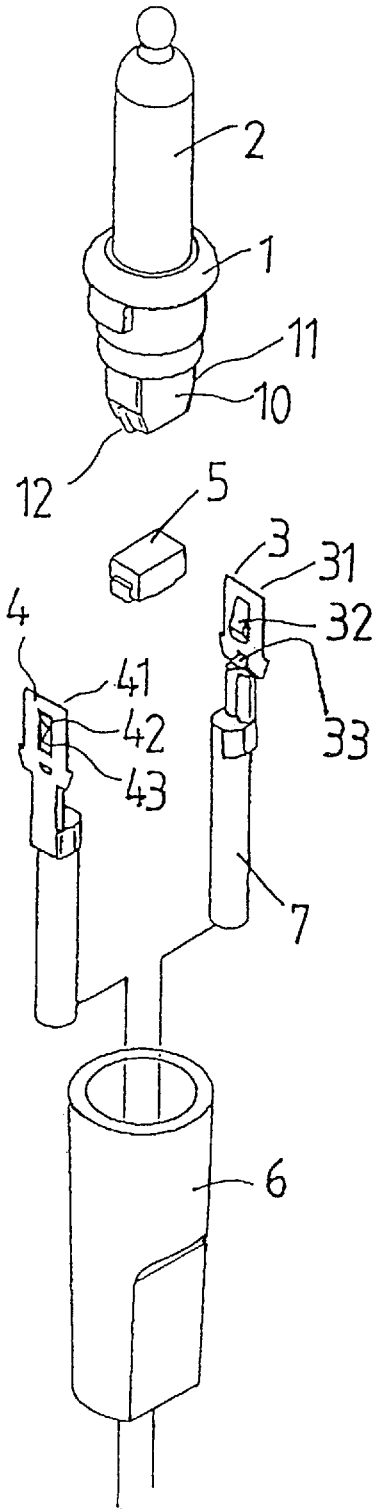
FIG. 2 is an exploded perspective view showing the separated elements of the present invention.
Figure 3:
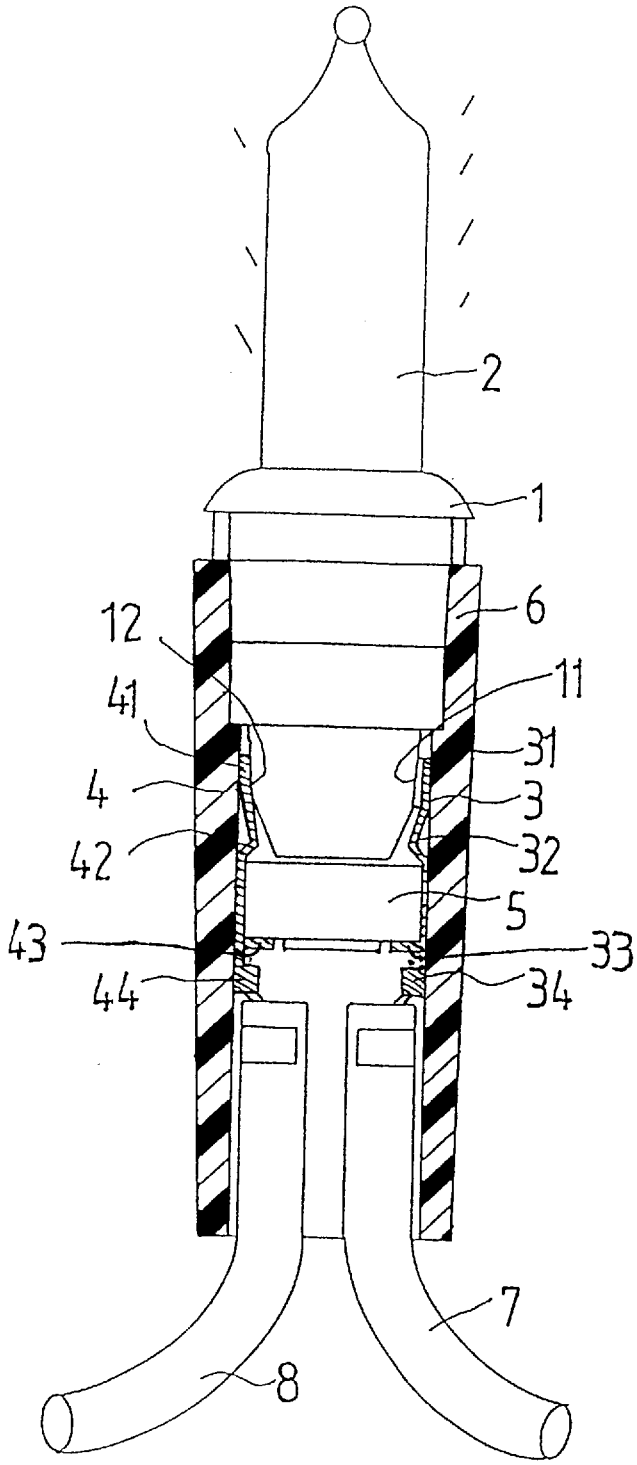
FIG. 3 is a cross-sectional view of the present invention.

FIG. 1 is a perspective view showing one embodiment of the present invention, and FIG. 2 is an exploded perspective view showing the separated elements of the present invention. FIG. 3 is a cross-sectional view of the present invention, and it can be seen from FIG. 3, the present invention includes: a lamp socket 1, a lamp 2, a pair of copper connection plugs 3, 4, a resistor sheet 5, a lamp base unit 6 and a pair of wires 7, 8. The lamp 2 can be put into the lamp socket 1, and there are conductive sheets 11, 12 at both bottom sides of the lamp socket 10. Each of the conductive sheet 11, 12 at both bottom sides of the lamp socket 1 contacts with a copper connection plugs 3, 4, and the upper portion of the connective sheets 11, 12 are in the form of plate, wherein upper protrusions 32, 42 and lower protrusions 33, 43 are provided. The resistor sheet 5 is provided between the upper protrusions 32, 42 and the lower protrusions 33, 43. The resistor sheet 5 is fixed to avoid loosening and wire fixtures 34, 44 are formed at the lower portion of the copper connection plugs 3, 4, and the wire fixtures 34, 44 can fix the wires 7, 8. The wires 7, 8 are connected to the other lamp base units of the series lamps. When the lamp series are turned on, the current will flow from wires 7, 8 to connection plug 3, 4 and the conductive sheets 11, 12 under the lamp socket 1 to light on the lamp in the lamp base of the lamp series. If the lamp 2 is burnt out or loose, the resistor sheet 5 will become short to make the lamp in other lamp base units light as the same.

Figure 4:
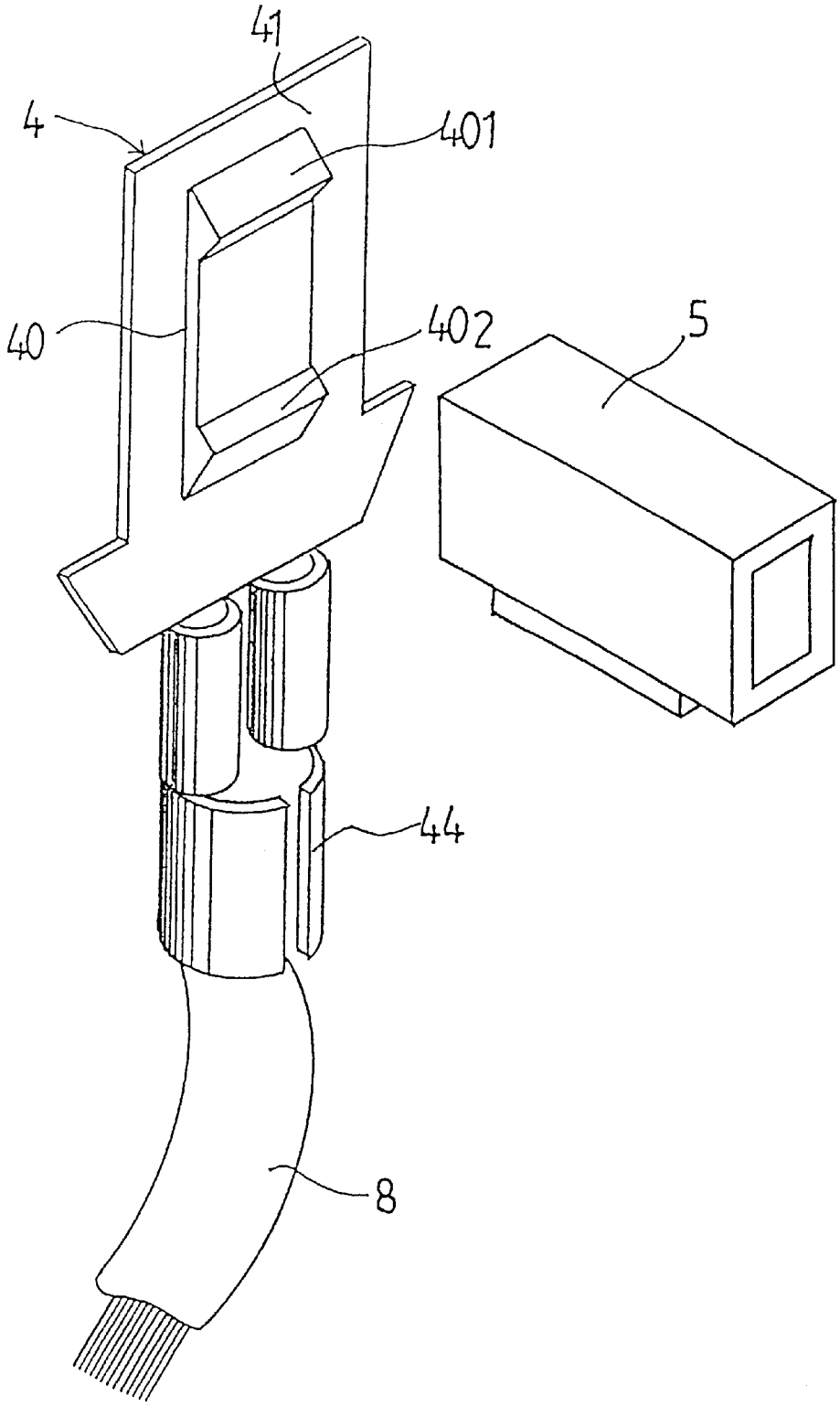
FIG. 4 is the copper connection plug of a second embodiment of the present invention.
Figure 5:
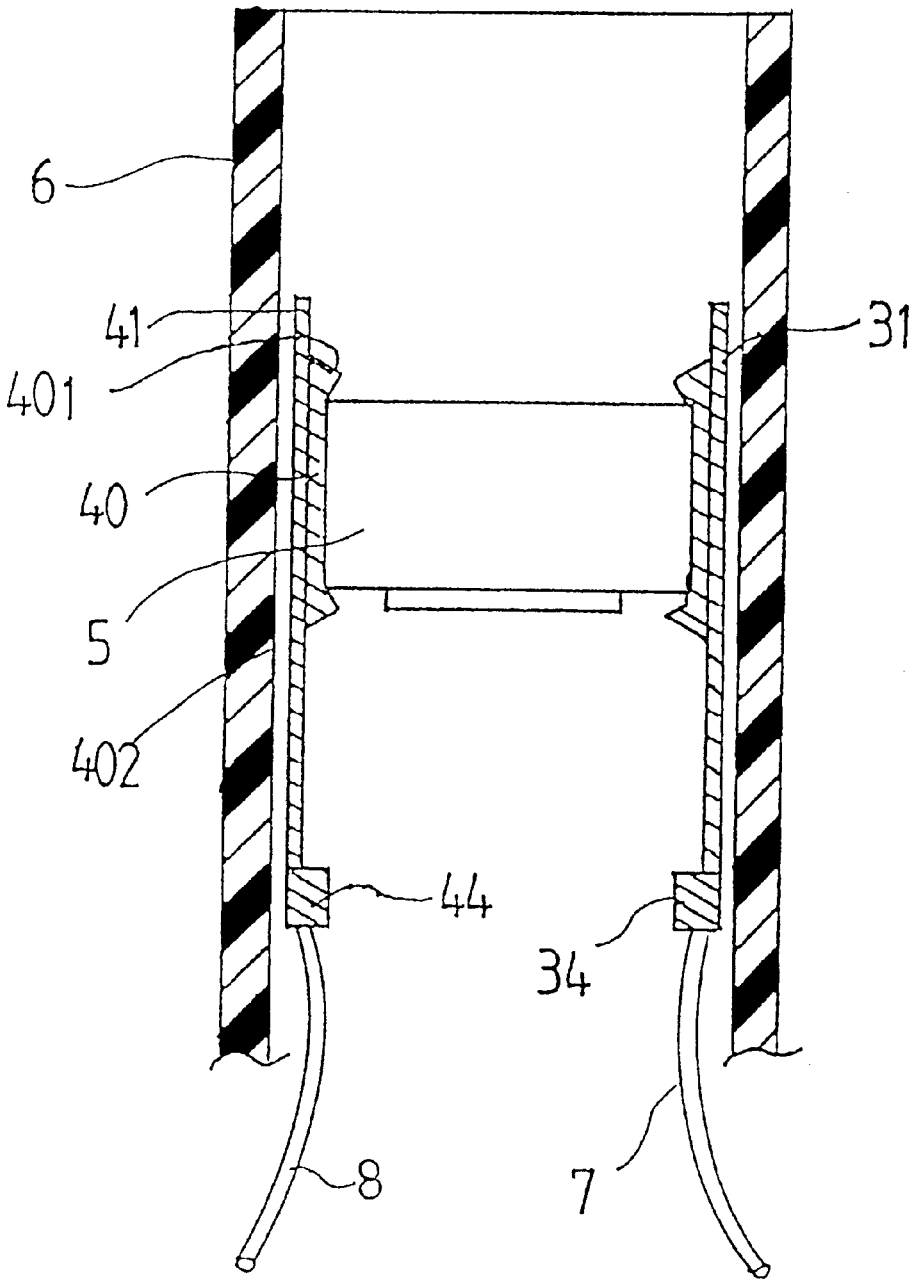
FIG. 5 is the cross-sectional view of the copper connection plug of the second embodiment of the present invention.

The connection plugs 3, 4 according to the present invention can be provided as in FIGS. 4 and 5. A plug 40 is formed between the upper portion of the connection plugs 31, 41, and there are protrusions 401, 402 formed at the upper and lower portions of the plugs 40. The protrusions 401, 402 can be placed against the resistor sheet 5 to fix it in a predetermined position.

From the above description, the improvement of the lamp base of the lamp series according to the present invention can function as well even though one or more lamps are burnt out or loose, so the drawback of the convention lamp series can be improved.

The invention may be embodied in other specific forms without departing from the spirit of essential characteristics thereof. The present embodiments are therefore to be considered in all respects as illustrative and restrictive, the scope of the invention being indicated by the appending claims rather than by the foregoing description and all changes which come within the meaning and range of equivalency of the claims are therefore intended to be embraced therein.

What is claimed is:

1. A lamp base for use in a lamp string having a plurality of lamp bases, the lamp base comprising:

a) a lamp base unit configured to accept therein a lamp socket having a pair of electrical conductors thereon;

b) a pair of electrical wires;

c) first and second connection plugs located within the lamp base unit, each connected to one of the pair of electrical wires and each located so as to contact one of the pair of electrical conductors of the lamp socket, the connection plugs being spaced apart from each other, each connection plug having first and second spaced apart protrusions extending therefrom, the protrusions on each connection plug extending toward the other connection plug; and, d) a resistor sheet extending between and in contact with the first and second connection plugs, the resistor sheet located between the first and second protrusions so as to be fixed in position by the first and second protrusions on each connection plug.

2. The lamp base of claim 1 wherein the first and second protrusions are formed integrally with each connection plug.

3. The lamp base of claim 1 wherein the first and second protrusions are formed on plug located on each connection plug.

* * * * *